US005205553A

United States Patent [19]

Okumoto et al.

[11] Patent Number: 5,205,553

[45] Date of Patent: Apr. 27, 1993

[54] GOLF CLUB

[75] Inventors: Takaharu Okumoto, Chigasaki; Tetsuo Hayashi, Hiratsuka, both of Japan

[73] Assignee: The Yokohama Rubber Co., Ltd., Japan

[21] Appl. No.: 797,031

[22] Filed: Nov. 25, 1991

[30] Foreign Application Priority Data

Nov. 28, 1990 [JP] Japan ..... 2-124174
Nov. 28, 1990 [JP] Japan ..... 2-124175

[51] Int. Cl.[5] ..... A63B 53/02

[52] U.S. Cl. ..... 273/80.8; 273/80.2; 273/174

[58] Field of Search ..... 273/167-175, 273/80.2-80.9, 77 R, 32 R, DIG. 23

[56] References Cited

U.S. PATENT DOCUMENTS 1,540,559 6/1925 Murphy ..... 273/80.3
2,146,321 2/1939 Wettlaufer ..... 273/80.8
2,299,735 10/1942 Birkhofer ..... 273/80.8
4,063,737 12/1977 Tom et al. ..... 273/174
4,614,343 9/1986 Radway ..... 273/80.6 X
4,854,583 8/1989 Kobayashi ..... 273/80.8

*Primary Examiner*—William H. Grieb
*Assistant Examiner*—Sebastiano Passaniti
*Attorney, Agent, or Firm*—Finnegan, Henderson, Farabow, Garrett & Dunner

[57] ABSTRACT

A golf club having a bottom plug fitted in a sole-side portion of a shaft receiving bore extending from the upper end of a club head to the lower surface of its sole plate, in which the plug has a smaller-diameter portion having an outer diameter substantially equal to the inner diameter of the club's shaft, and fitted in and bonded to the inner surface of the club shaft, and a larger-diameter portion having an outer diameter substantially equal to the inner diameter of the shaft receiving bore, and fitted in and bonded to the inner surface of the bore.

6 Claims, 6 Drawing Sheets

GOLF CLUB

BACKGROUND OF THE INVENTION

This invention relates to a golf club, and more particularly to a golf club, in which a shaft receiving bore in a club head extends into an opening in the lower surface of a sole plate, the club having an improved coupling strength between the club shaft and the club head as well as an improved manufacturing efficiency of and an improved processability of the materials of the golf club.

In a wood type golf club, distortion of the club head that occurs when a ball is driven therewith is lessened and the degree of pleasantness realized from the swing of the golf club as well as the degree of accuracy of direction of a ball driven therewith are increased, in proportion to the coupling strength of the club shaft with respect to the club head. In the past, to achieve the best coupling strength of a club shaft with respect to a club head, and with reference to FIG. 11, a shaft receiving bore 3 is provided in a club head 1 so that the bore 3 extends from the upper end of the hosel of the head into a sole plate 4 that has an opening in its lower surface. A club shaft 2 is then inserted into this bore 3 until the lower end of the club shaft 2 has reached the lower surface of the sole 4 and a bottom plug 6 is then fitted in the interior of the lower end portion of the club shaft 2 and fixed in this location. It has been accepted that a golf club in which the lower end of the club shaft 2 reaches the lower surface of the sole 4 has a high coupling strength and givers golfers a sense of security. The "high coupling strength of a golf shaft with respect to a sole" constitutes one of the conditions for advanced golfers' selecting a golf club.

When a club head 1 of a golf club in which the lower end of a club shaft 2 reaches the lower surface of a sole 4 is being manufactured, the club shaft 2 is typically inserted into a shaft receiving bore 3 so that it projects downwardly beyond the sole 4, the projecting end portion of the club shaft 2 then being cut off flush with the sole and the cut end of the club shaft polished. However, the presence of the upper portion of the club shaft 2 tends to interfere with this polishing operation and causes the productivity of the golf clubs to decrease greatly.

Golf clubs in which improvements have been made in view of such a low productivity problem include a golf club in which a club shaft 2 is inserted into a bore 3 so that its lower end thereof does not reach the lower surface of a sole 4, with a bottom plug 6 then being fitted from the lower side of the sole 4 in an opening portion 3*a*, which is in the sole 4, of the bore 3 as shown in FIG. 12. In the golf club of this construction, the club shaft 2 can be joined to a club head 1 after the club head 1 has been polished independently of the club shaft. Accordingly, polishing of the club head 1 is not obstructed by the club shaft 2, so that productivity of the golf club is higher.

Although the golf club shown in FIG. 12 has an excellent processability of the materials therefor and an excellent productivity, the length of the portion of the club shaft 2 which is inserted into the head body becomes shorter. Therefore, the area of the surfaces bonded together between the club shaft 2 and club head 1 decrease as compared with that of the corresponding surfaces in the golf club of FIG. 11, so that the coupling strength of the club shaft 2 with respect to the club head 1 becomes lower.

In order to regulate the weight of these golf clubs of FIGS. 11 and 12, weight balance regulating weights 8 are inserted as shown in FIGS. 13 and 14 respectively on the bottom plugs 6 which are fitted in the bore 3 as mentioned above.

However, it is very difficult to regulate the weight balance of such golf clubs by means of the weights 8 fitted in the interior of the shaft receiving bores 3. Especially, the golf club of FIG. 12 in which the club shaft 2 is inserted into the bore 3 so that the lower end of the club shaft 2 is located within the bore 3 and does not reach the sole 4, because here the length of the portion of the club shaft 2 which is inserted into the bore 3 has to be decreased by a distance corresponding to the total length of the bottom plug 6 and weight 8. Therefore, the area of the surfaces bonded together between club shaft 2 and club head 1 decrease even more causing yet a further decrease in the coupling strength of these parts.

SUMMARY OF THE INVENTION

An object of the present invention is to provide a golf club having an improved coupling strength of a club shaft to a club head as well as an improved manufacturing efficiency of the golf club and processability of the materials therefor.

Another object of the present invention is to provide a golf club capable of finely regulating the balance of weight thereof with ease without substantially reducing the length of the portion of the club shaft which is inserted in the bore in the club head.

Still another object of the present invention is to provide a golf club having an outer appearance identical with that of a golf club in which the lower end of the club shaft reaches the lower surface of the sole, thus giving a golfer a sense of security.

A golf club according to the present invention which achieves these objects comprises a club head, a club shaft inserted and fixed in a shaft receiving bore extending from the upper end of a hosel to the lower surface of a sole through a sole body, and a bottom plug fitted in a sole-side portion of the shaft inserting bore, characterized in that the bottom plug has a small-diameter portion and a large-diameter portion. The former has an outer diameter substantially equal to the inner diameter of the club shaft and is fitted in and bonded to the inner surface of the club shaft. The latter has an outer diameter substantially equal to the inner diameter of the shaft inserting bore and is fitted in and bonded to the inner surface of the shaft inserting bore.

Since the bottom plug is fitted in the shaft receiving bore in the club head so that the lower end of the club shaft does not reach the lower surface of the sole, it becomes possible to polish the club head independently of the club shaft as in the golf club of FIG. 12, and this enables the productivity of the golf clubs to be improved. Since the bottom plug has smaller-and larger-diameter portions, which are inserted and fixed in the club shaft and shaft receiving bore respectively, the area of the surfaces bonded together is increased, and this enables the coupling strength of the club shaft to club head to be improved. Moreover, it becomes possible to regulate the weight balance of the club head finely and easily, simply by changing the combination of the material quality of the bottom plug.

DESCRIPTION OF THE PREFERRED EMBODIMENTS

Figure 1:
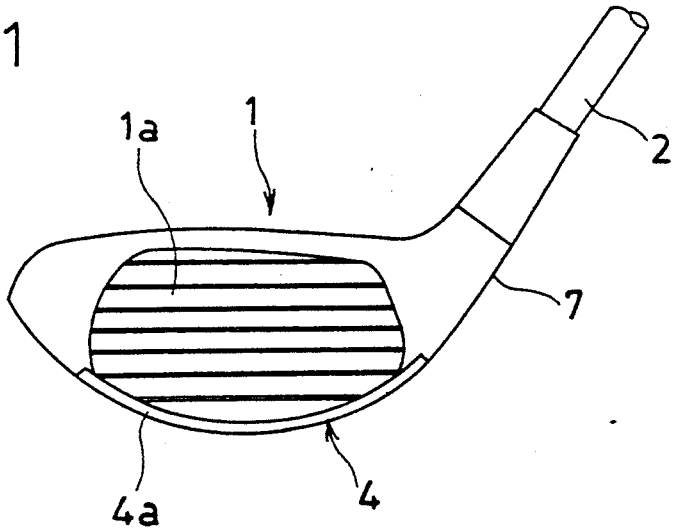
FIG. 1 is a front elevation of the club head portion of a wood type golf club embodying the present invention.
Figure 2:
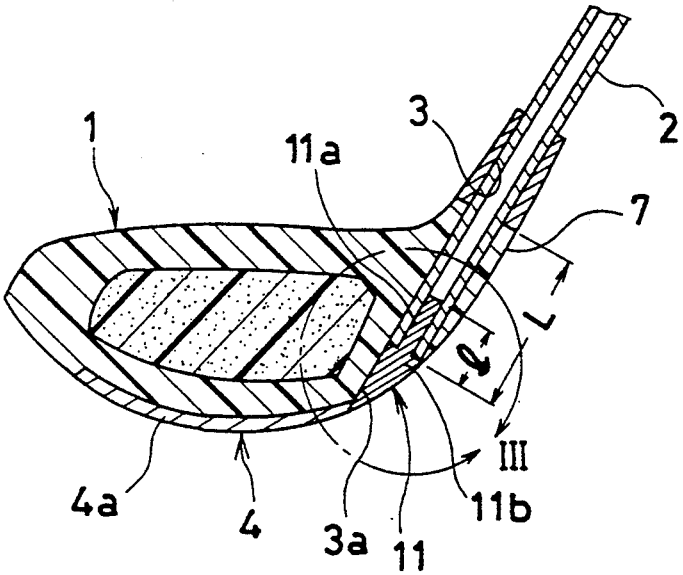
FIG. 2 is a sectional view of the wood type golf club of FIG. 1 taken along a plane including the axis of the club shaft and substantially parallel to a face portion of the club head.

Referring to the wood type golf club shown in FIGS. 1–2, reference numeral 1 denotes a club head, and 2 a club shaft. This club head 1 has a ball hitting face la at the front side thereof, and a hosel 7 at the heel side thereof. The hosel 7 is provided therein with a shaft receiving bore 3 that extends from an upper end thereof to the lower surface of a sole plate 4, in which bore 3, the club shaft 2 is inserted and fixed. The lower end of the club shaft 2 does not reach the lower end surface, which is flush with the lower surface of the sole plate 4, of the shaft receiving bore 3, and a bottom plug 11 is fitted in and bonded to the inner surface of an opening 3*a* in the sole plate 4 and the lower end of bore 3.

Figure 3:
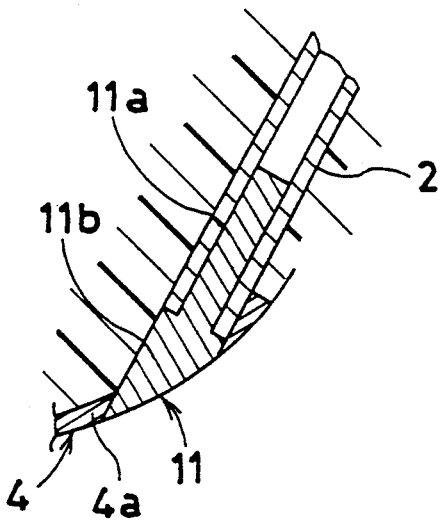
FIG. 3 is an enlarged view of a portion III of FIG. 2.
Figure 4:
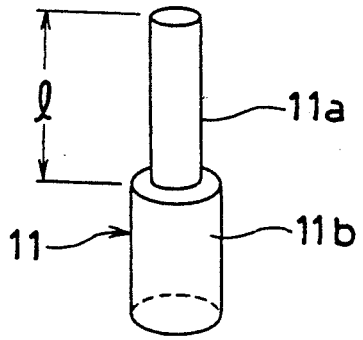
FIG. 4 is a perspective view of a bottom plug used in the golf club of FIGS. 1 and 2.

As shown in FIGS. 3–4, this bottom plug 11 comprises a smaller-diameter portion 11*a* having an outer diameter substantially equal to the inner diameter of the lower end portion of the club shaft 2, and a larger-diameter portion 11*b* having an outer diameter substantially equal to the inner diameter of the opening 3*a* and the shaft receiving bore 3. The smaller-diameter portion 11*a* of this bottom plug 11 is inserted in and bonded to the inner surface of the lower end portion of the club shaft 2, while the larger-diameter portion 11*b* is fitted in and bonded to the inner surface of the opening 3*a*, which is positioned in the sole 4, and of the bore 3.

Figure 5:
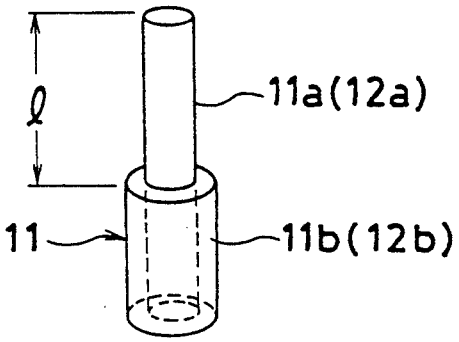
FIG. 5 is a perspective view of another embodiment of the bottom plug used in the present invention.
Figure 6A:
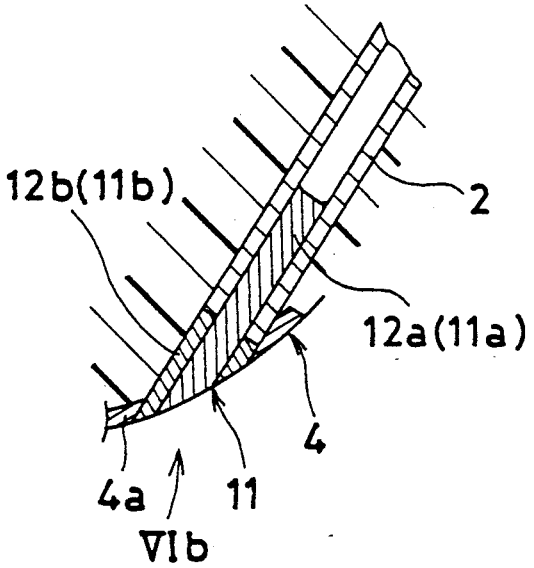
FIG. 6 is an enlarged sectional view similar to FIG. 3 of a combined portion of a club head and shaft in which the bottom plug of FIG. 5 is used.
FIG. 6*b* is a view taken in the direction of the arrow VIb in FIG. 6*a*.
Figure 6B:
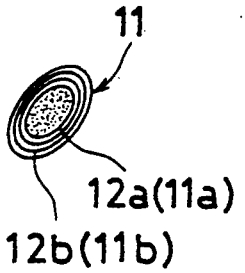

It is desirable that the bottom plug 11 having the above-mentioned shape be formed out of material of a high strength. For example, a bottom plug integrally injection molded out of a fiber-reinforced plastic or an engineering plastic can preferably be used. Instead of such an integrally molded bottom plug, a bottom plug 11 as shown in FIGS. 5–6 can also be employed. In this bottom plug 11, a smaller-diameter portion 11*a* and a larger-diameter portion 11*b* comprise a cylindrical rod 12*a* and a tubular member 12*b* respectively, the rod 12*a* being inserted in and combined with the tubular member 12*b* as shown in FIG. 5. In this case, rod 12*a* is preferably formed out of a fiber-reinforced plastic material comprising a plastic in which reinforcing fibers, such as carbon fibers set in a lengthwise parallel-extending state, for example formed by a protrusion method, are mixed, and the tubular member 12*b* preferably a fiber-reinforced plastic, which is composed of reinforcing fibers and a resin, and which is tubularly molded by a sheet winding method or a filament winding method. If a bottom plug 11 comprising a rod 12*a* and a tubular member 12*b* composed of such molded fiber reinforced plastics is fitted in and bonded to the inner surfaces of the opening 3*a* and of a club shaft as before, a product shown in FIGS. 6*a* and 6*b* is obtained. When the bottom plug 11 is viewed from the outer side of the sole 4, a concentric circular pattern of laminated layers is seen as shown in FIG. 6*b*. This bottom plug 11 has a pleasing outer appearance, and the club head thereof looks as if the club shaft 2 extends down to the lower surface of the sole plate 4. This gives a golfer a sense of security.

The length l of the smaller-diameter portion 11*a* of the plug that is inserted in the interior of the club shaft 2 is generally shorter than the length L of the portion of the club shaft 2 which is inserted in the club head 1. However, the smaller-diameter portion 11*a* may be formed so that it can be inserted into club shaft 2 beyond the upper end of the hosel 7, i.e., the length l of the smaller-diameter portion 11*a* inserted in the club shaft 2 may be set longer than that L of the portion of the club shaft 2 which is inserted in the club head 1. This will prevent club shaft 2 from being broken in the vicinity of the upper end of the hosel 7.

Figure 9A:
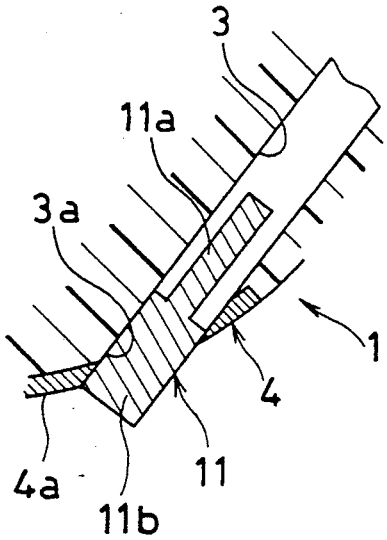
FIGS. 9*a*–9*c* illustrate the steps of combining a club head and club shaft of the golf club according to the present invention with each other.
Figure 9B:
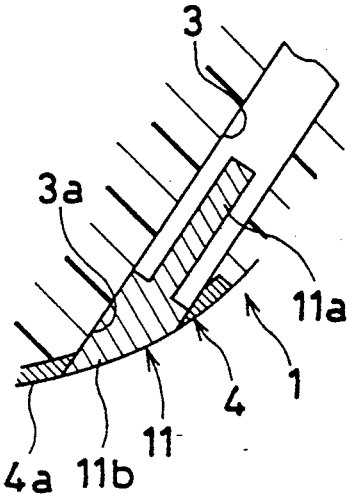
Figure 9C:
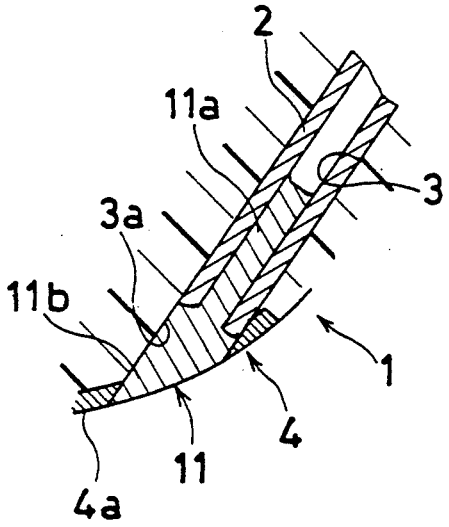
Figure 10A:
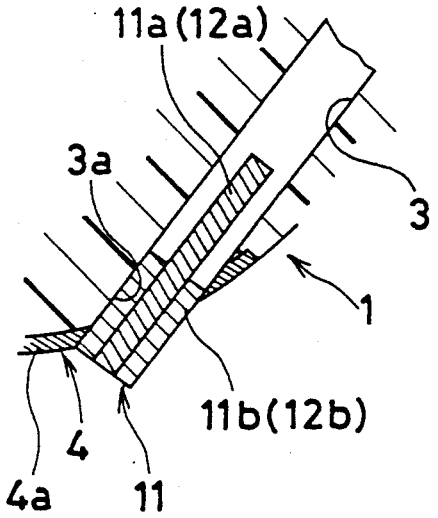
FIGS. 10*a*–10*c* illustrate the steps of combining a club head and club shaft of another embodiment of the present invention.
Figure 10B:
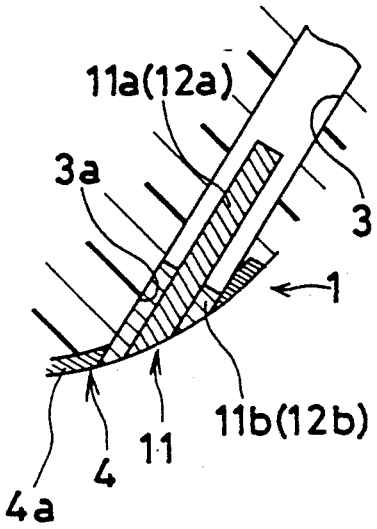
Figure 10C:
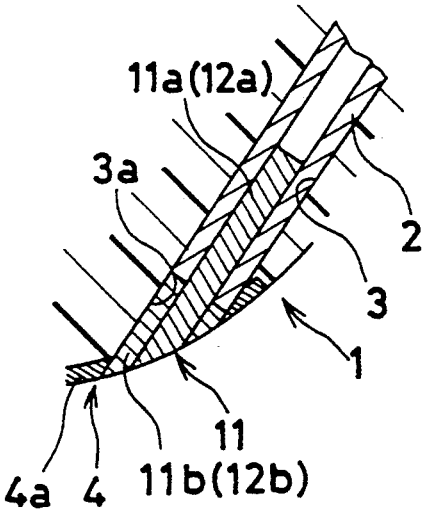
Figure 11:
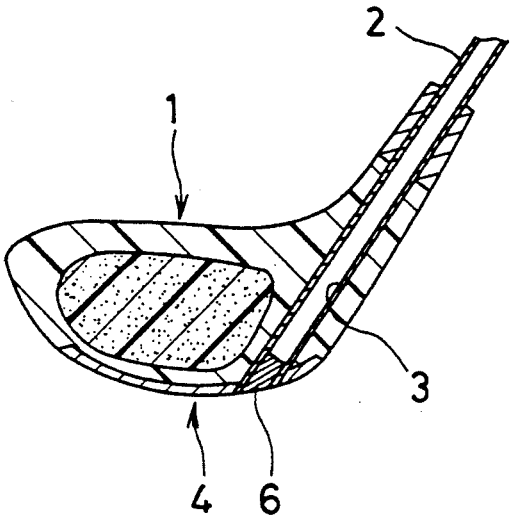
FIG.11 PRIOR ART
FIGS. 11 and 12 are sectional views showing the combined portions of the club head and club shaft of a conventional wood type golf club.
Figure 12:
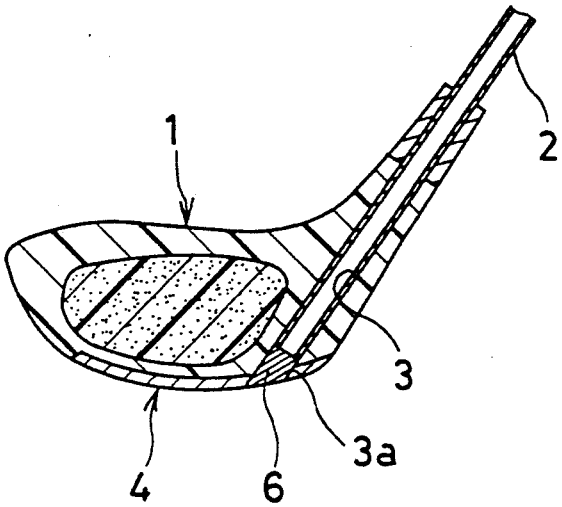
FIG.12 PRIOR ART
Figure 13:
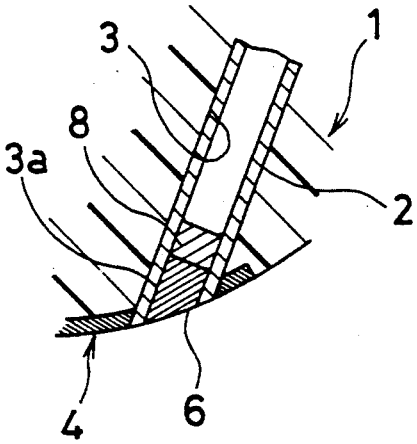
FIG.13 PRIOR ART
FIGS. 13 and 14 are sectional views of a structure for regulating the weight of the club head of a conventional wood type golf club.
Figure 14:
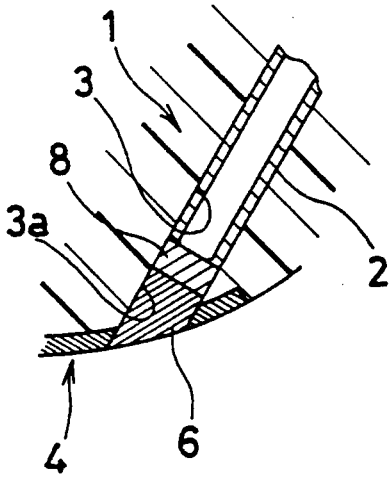
FIG.14 PRIOR ART

The combining of the club shaft 2 with the club shaft 1 by using the bottom plug 11 of FIG. 4 can be done in accordance with the steps illustrated in FIGS. 9*a*–9*c*, while the combining of the club shaft 2 with club head 1 using the bottom plug 11 of FIG. 5, can be done in accordance with the steps illustrated in FIGS. 10*a*–10*c*. In the former case, the bottom plug 11 is fitted and fixed (FIG. 9*a*) via a bonding agent in the opening 3*a* in sole plate 4 and in the lower end of the shaft receiving bore 3 formed in the club head 1. After the bottom plug 11 has been fixed in place, the end portion of the bottom plug 11 which projects beyond the lower surface 4*a* of sole plate 4 is cut off, and the cut end of the bottom plug 11 and the lower surface 4*a* of the sole plate are then subjected to finish polishing (FIG. 9*b*). After this processing of the club head 1 has thus been completed, the lower end portion of the club shaft 2 to which a bonding agent is applied is then inserted into the shaft receiving bore 3 so as to fit the club shaft 2 around the smaller-diameter portion 11*a* of the bottom plug 11 (FIG. 9*c*). To improve the bonding strength, it is preferable that the surfaces of the smaller- and larger-diameter portions 11*a*, 11*b* and the inner and outer surfaces of the portion to be inserted of the club shaft 2 be roughened with sandpaper before the above-described combining operation is carried out.

Since the combining of the club head 1 and club shaft 2 with each other is done as mentioned above, the club head 1 alone can be subjected to polishing and painting independently of the club shaft 2, and this enables the operation efficiency to be markedly improved. Since the smaller-diameter portion 11*a* of the bottom plug 11 is fitted and fixed in the interior of the lower end portion of the club shaft 2 with the larger-diameter portion 11*b* fitted and fixed in the shaft receiving bore 3, the area of the bonded surfaces increases, so that the bonding strength of the club shaft 2 and club head 1 can be improved.

When it is necessary to finely regulate the weight of the club head for the regulation of the weight balance of the golf club according to the present invention, it is convenient that the bottom plug 11 shown in FIG. 5 be used, so that the rod 12*a* thereof can be formed out of a metallic material of a high specific gravity. The length l of the portion of this rod 12*a* of a metallic material of a high specific gravity which is inserted into the bore 3 may be regulated, whereby fine regulation of the weight of the club head 1 can be easily effected. In this bottom plug, the tubular member 12*b* is preferably formed out of the same material as the club shaft 2. In the case where the tubular member 12*b* is formed out of a fiber-reinforced plastic which is composed of reinforcing fibers and a resin, and which is tubularly molded by a sheet winding method, a filament winding method is used. The lower surface of the bottom plug 11 viewed in the direction corresponding to the direction of arrow VI*b* in FIG. 6*a* will then display a concentric circular pattern of laminated layers having the lower end of the rod 12*a* of a metallic material as the center thereof, so that the appearance of the lower surface of this club head is identical with that of a club head in which the club shaft 2 extends down to the lower surface of the sole plate 4.

When the rod 12*a* consists of a metallic material, the length l of the portion thereof which is inserted into the interior of the club shaft 2 is preferably set so that it does not exceed the length L of the portion of the club shaft 2 between the lower end thereof and the upper end of the hosel 7. If the length l of the inserted portion is longer than the length L, the bonding strength of the club head 1 and club shaft 2 will increase, but the stress will then be concentrated on the portions of these parts which are in the vicinity of the upper end of the hosel 7 which increases the danger of the club shaft 2 being broken.

Figure 8:
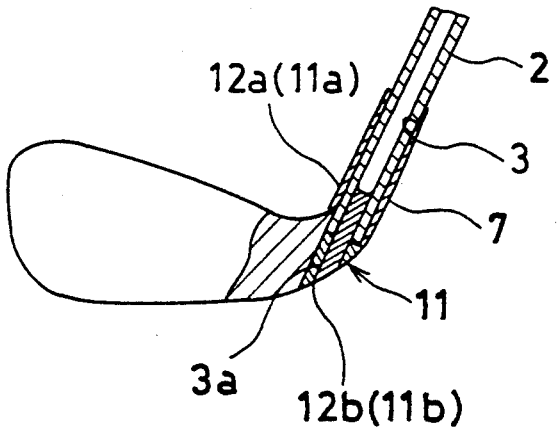
FIG. 8*a* is a partially sectioned front elevation of a club head of an iron type golf club embodying the present invention.

The above is a description of a wood type golf club. The present invention can also be applied to an iron type golf club as shown in FIG. 8.

Figure 7:
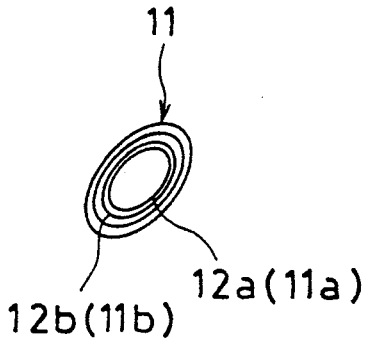
FIG. 7 is a view, which corresponds to FIG. 6*b*, of a bottom plug-fitted portion in which a metallic material is used for a rod portion of the bottom plug with a sheet-wound molded material used for the larger-diameter portion thereof.

As described above, the golf club according to the present invention is capable of improving the strength of the joint portions of the club shaft and club head while improving the manufacturing and material processing efficiency. When it is necessary to finely regulate the weight of the club head for the purpose of regulating the weight balance of the golf club, the requirement can be satisfied easily by using a bottom plug as shown in FIG. 5. Since the outer appearance of this golf club is identical with that of a golf club in which the club shaft extends to the lower surface of the sole thereof, as shown in FIGS. 6*b* and 7, the golf club according to the present invention gives golfers a greater sense of security.

What is claimed is:

1. A golf club comprising a club head having a hosel portion having an upper end and a sole portion having a lower surface, a shaft receiving bore having an inner annular surface extending from an opening in the upper end of the hosel portion to an opening in the lower surface of the sole portion, a tubular club shaft having a lower end and an inner annular surface extending downwardly into said bore, a bottom plug having a lower and fitted in said opening in said sole portion and extending upwardly into said bore, said bottom plug comprising a smaller-diameter upper portion having an outer diameter substantially equal to the diameter of the inner annular surface of the club shaft, said upper portion being inserted into the lower end of and being bonded to said inner surface of said tubular club shaft, and a larger-diameter lower portion having an outer diameter substantially equal to the diameter of said inner annular surface of said shaft receiving bore and being fitted in and bonded to said inner surface of said bore, said lower portion extending between said upper portion and the lower end of the plug, the lower end of said plug being flush with and exposed on the lower surface of the sole portion, wherein said upper portion of said bottom plug comprises a rod and said lower portion of said bottom plug comprises a separate tubular member, said rod extending through said tubular member to said lower end of said plug and being integrally combined with said tubular member to form said bottom plug and wherein said tubular member is of a fiber reinforced plastic material.

2. The golf club of claim 1, wherein said rod is also of a fiber-reinforced plastic material.

3. The golf club of claim 1, wherein said rod is of a metallic material.

4. The golf club of claim 1, wherein said tubular member is of the same material as that of said club shaft.

5. The golf club of claim 1, including a sole plate affixed to the sole portion of the club having an opening therein aligned with said shaft receiving bore.

6. The golf club of claim 1, wherein the length of said rod which is inserted into the lower end of said club shaft does not extend beyond the opening in the upper end of said hosel portion of the club.

* * * * *